US005249107A

United States Patent [19]

Poulsen

[11] Patent Number: 5,249,107

[45] Date of Patent: Sep. 28, 1993

[54] LOW VOLTAGE LIGHTING FIXTURE

[76] Inventor: Peder U. Poulsen, Huntington Rd Box 197, Stratford, Conn. 06497

[21] Appl. No.: 794,964

[22] Filed: Nov. 20, 1991

[51] Int. Cl.[5] ..... F21V 21/00

[52] U.S. Cl. ..... 362/249; 362/147; 362/404; 362/407

[58] Field of Search ..... 362/145, 147, 148, 227, 362/228, 404, 405, 407, 806, 236, 243, 249

[56] References Cited

U.S. PATENT DOCUMENTS

| | | | |
|---|---|---|---|
| 3,693,000 | 9/1972 | Picard | 362/273 |
| 4,497,016 | 1/1985 | Sachse | 362/294 |
| 4,796,166 | 1/1989 | Greenberg | 362/96 |

*Primary Examiner*—Stephen F. Husar
*Attorney, Agent, or Firm*—John H. Crozier

[57] ABSTRACT

A ceiling canopy for a pendant light fixture comprising a cup shaped enclosure which serves to conceal the ceiling box and electrical connections and means of suspension of the fixture, with the additional feature of containing a low voltage power supply like e.g. a toroidal transformer surrounding the pendant suspension cord and having, on its external surface, means for mounting one or several individually adjustable lamp holders for low voltage reflector lamps which are powered from said power supply and may be directed towards individual objects in the room.

14 Claims, 1 Drawing Sheet

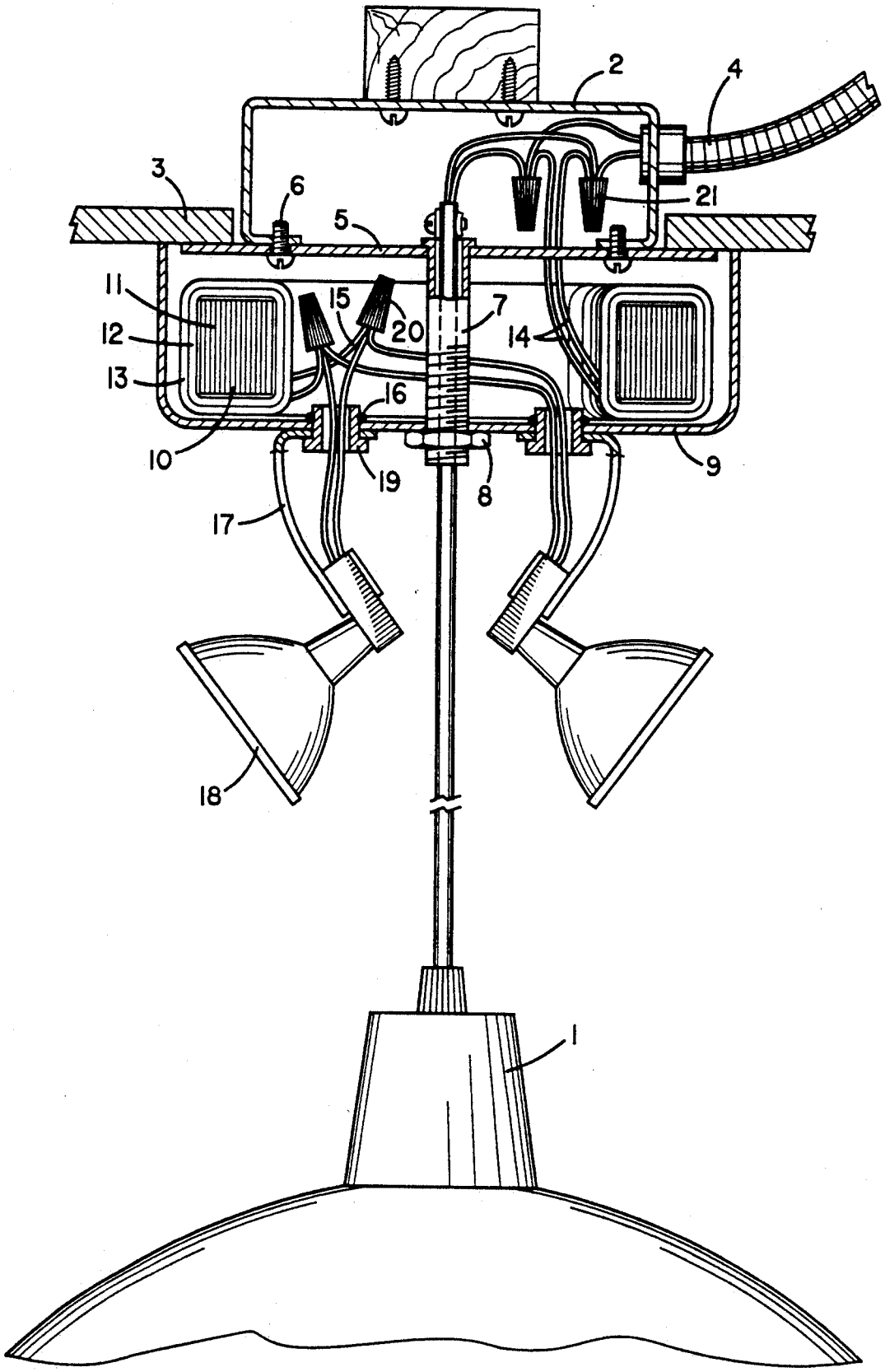
2
4
3
6
21
5
11
15
7
12
20
14
13
16
10
19
8
9
17
18
1

LOW VOLTAGE LIGHTING FIXTURE

This invention relates to low voltage lighting fixtures in general and more specifically to fixtures for so called accent lighting of architecture and art objects.

Accent lighting is often done with tungsten/halogen bulbs, a novel type of incandescent lamp which is easily combined with a parabolic reflector enabling a light beam to be directed towards e.g. a single painting or other object with a high degree of accuracy. In low voltage systems often several bulbs are being powered from one source like e.g. a transformer, rendering possible countless combinations of bulbs of different wattage and beam configuration. In this type of set up the bulbs and their fixtures may be mounted individually or e.g. attached to a common base or a track which is again attached to a wall or ceiling.

The aim of the present invention is to provide a simple, inexpensive system for adding low voltage accent lighting to conventional hanging lamp installations. In the majority of cases hanging lamps, so called pendants, are hooked up to the line inside electrical boxes which are recessed in the ceiling. Usually the lamps are suspended by their cords by means of a stress relief device on a crossbar which mounts diagonally across the ceiling box by means of two screws.

In most cases, as the lamp is installed, a so called canopy with a central hole is threaded onto the cord, and as the final stage of the installation process the canopy is raised until it rests against the ceiling and a friction device tightened around the cord to keep it in place. The objective of the canopy, which often serves as an ornament in itself, is to conceal the ceiling box with its wiring and the crossbar which supports the lamp.

The invention describes a light fixture which replaces the canopy in new and already existing lighting installations and which contains a power supply for and serves as a common base for one or several low voltage reflector lamps. The lamps are installed in individually adjustable mounts and may be directed towards a multitude of objects in the room, thus adding multiple accent lighting to the general illumination provided by the hanging lamp.

The invention will be described in the following with reference to the drawing, wherein

THE DRAWING

The drawing illustrates a lighting fixture according to the invention which has been installed above and replaces the canopy of a pendant lamp 1 whereof only the top contour is shown. 2 is an electrical box which is recessed into and mounted flush with a ceiling 3 and is supplied via a flexible cable or conduit 4. A cover 5 is fitted by means of screws 6 and provided with a threaded pipe 7 which serves as a conduit for the pendant cord and at the same time as mount for the fixture by means of a central nut 8. The fixture consists of a cup shaped enclosure 9 which contains a toroidal low voltage transformer 10 surrounding the pipe 7. The transformer may be attached to the enclosure by means of a suitable adhesive or sheet metal lugs not shown.

The transformer consists of a strip wound core 11 with surrounding primary and secondary windings 12 and 13 which are terminated via line voltage and low voltage lead wires 14 and 15 respectively.

The bottom of the enclosure 9 is provided with a pattern of holes or knockouts 16 which serve to mount one or several individually adjustable lamp holders 17 for low voltage reflector lamps 18. For purpose of simplicity the holders may be made of sheet metal and each holder may be pivoted around its mount and bent into the desired shape in order to aim each beam towards its individual target. The leads from each lamp holder are passed through the tubular mounts 19 and all are hooked up to the low voltage side of the transformer by means of wire nuts 20.

The transformer shown in cross section could be a full size representation of a 100 watt unit and might power e.g. two 50 watt, three 35 watt or five 20 watt lamps or combinations of different wattages adding up to about 100 watts. The beam configurations may be any combination of narrow, medium or flood to meet specific requirements. In the described fashion one, central light fixture may provide accent lighting of several paintings or other objects in the room. Because the primary leads 14, from the transformer are extended through a hole in the box cover 4 into the box 2, where they are hooked up to the supply line in parallel with the pendant, the two light fixtures may be controlled from the same wall switch or dimmer.

Although in the above, the power supply for the lamps 18 has been referred to as a transformer or, more specifically, a toroidal transformer, it is within the scope of the invention to use a different type of low voltage power supply like e.g. a so called switching power supply which does not include a line frequency power transformer.

What is claimed is:

1. A ceiling canopy for a pendant light fixture, said canopy being of the type concealing an electrical box mounted in said ceiling from which said pendant light fixture depends, said ceiling canopy comprising:

(a) a generally cup-shaped housing through which said pendant fixture depends, said housing to conceal said electrical box mounted in said ceiling;

(b) a transformer disposed in said housing; and (c) attachment means to attach at least one low voltage lamp to said housing.

2. A ceiling canopy, as defined in claim 1, wherein said transformer is a toroidally shaped transformer.

3. A ceiling canopy, as defined in claim 1, wherein said attachment means comprises at least one opening in said housing into which a low voltage light mounting bracket can be inserted and held therein without the use of fasteners.

4. A ceiling canopy, as defined in claim 3, wherein said mounting bracket includes a sheet metal arm which can be bent to selectively position the beam of said lamp.

5. A ceiling canopy, as defined in claim 3, wherein said transformer is a horizontally disposed toroidally shaped transformer and said at least one opening is disposed in a circle defined internally by a said transformer.

6. A ceiling canopy, as defined in claim 1, wherein said cup shaped housing is attached to said electrical box such that the upper rim of said housing engages said ceiling.

7. A ceiling canopy, as defined in claim 1, further comprising a cover disposed over said electrical box, such that high voltage and low voltage electrical connections are separated thereby.

8. A ceiling canopy, as defined in claim 1, wherein said ceiling canopy is adapted to be retrofitted to an existing pendant light fixture.

9. A ceiling canopy for a pendant light fixture, said canopy being of the type concealing an electrical box mounted in said ceiling from which said pendant light fixture depends, said ceiling canopy comprising:

(a) a generally cup-shaped housing through which said pendant fixture depends centrally thereof, said housing having a wall portion surrounding a base portion, and said housing to conceal said electrical box mounted in said ceiling;

(b) a toroidally shaped transformer disposed in said housing in proximity to said wall portion; and (c) at least one low voltage lamp attached to a mounting bracket extending from an opening defined in said base portion, said opening being disposed internally of said toroidally shaped transformer.

10. A ceiling canopy, as defined in claim 9, wherein said light mounting bracket can be inserted and held in said opening without the use of fasteners.

11. A ceiling canopy, as defined in claim 10, wherein said mounting bracket includes a sheet metal arm which can be bent to selectively position the beam of said lamp.

12. A ceiling canopy, as defined in claim 9, wherein said cup shaped housing is attached to said electrical box such that the upper rim of said housing engages said ceiling.

13. A ceiling canopy, as defined in claim 9, further comprising a cover disposed over said electrical box, such that high voltage and low voltage electrical connections are separated thereby.

14. A ceiling canopy, as defined in claim 9, wherein said ceiling canopy is adapted to be retrofitted to an existing pendant light fixture.

* * * * *